US008322317B2

(12) United States Patent
Suzuki et al.

(10) Patent No.: US 8,322,317 B2
(45) Date of Patent: Dec. 4, 2012

(54) VALVE TIMING CONTROL APPARATUS

(75) Inventors: Shigemitsu Suzuki, Takahama (JP); Naoto Toma, Kariya (JP); Takeo Asahi, Kariya (JP)

(73) Assignee: Aisin Seiki Kabushiki Kaisha, Kayiya-shi, Aichi-ken (JP)

( * ) Notice: Subject to any disclaimer, the term of this patent is extended or adjusted under 35 U.S.C. 154(b) by 371 days.

(21) Appl. No.: 12/641,622

(22) Filed: Dec. 18, 2009

(65) Prior Publication Data

US 2010/0186697 A1 Jul. 29, 2010

(30) Foreign Application Priority Data

Jan. 28, 2009 (JP) ..... 2009-016879

(51) Int. Cl.
*F01L 1/34* (2006.01)

(52) U.S. Cl. ..... 123/90.17; 123/90.15; 464/160

(58) Field of Classification Search ..... 123/90.15, 123/90.17; 464/1, 2, 160
See application file for complete search history.

(56) References Cited

U.S. PATENT DOCUMENTS 5,301,639 A 4/1994 Satou
5,901,674 A 5/1999 Fujiwaki
6,129,062 A 10/2000 Koda
6,308,672 B1 10/2001 Lichti et al.
7,013,854 B1 3/2006 Heintzen et al.
2007/0186887 A1 8/2007 Pierik et al.

FOREIGN PATENT DOCUMENTS

JP 2001-132417 A 5/2001
JP 2004-340142 A 12/2004

OTHER PUBLICATIONS

European Search Report issued Jul. 20, 2010 by the European Patent Office in European Patent Application No. 09 01 5729.

*Primary Examiner* — Ching Chang
(74) *Attorney, Agent, or Firm* — Buchanan Ingersoll & Rooney PC

(57) ABSTRACT

A valve timing control apparatus includes a driving side rotational member, a driven side rotational member, a fluid pressure chamber, a dividing portion formed at the other one of the driving side rotational member and the driven side rotational member so as to divide the fluid pressure chamber into an advanced angle chamber and a retarded angle chamber, and a fluid control valve portion arranged orthogonally relative to the camshaft at an opposite side of the camshaft so as to dispose the driving side rotational member and the driven side rotational member between the fluid control valve portion and the camshaft, the fluid control valve portion including a first linearly moving member linearly moving in an orthogonal direction relative to the camshaft, thereby controlling supplying and discharging of a fluid relative to the advanced angle chamber and the retarded angle chamber.

14 Claims, 10 Drawing Sheets

VALVE TIMING CONTROL APPARATUS

CROSS REFERENCE TO RELATED APPLICATIONS

This application is based on and claims priority under 35 U.S.C. §119 to Japanese Patent Application 2009-016879, filed on Jan. 28, 2009, the entire content of which is incorporated herein by reference.

TECHNICAL FIELD

This disclosure relates to a valve timing control apparatus for controlling a relative rotational phase of a driven side rotational member relative to a driving side rotational member, rotating synchronously with a crankshaft of an internal combustion engine.

BACKGROUND DISCUSSION

A known valve timing control apparatus, disclosed in JP2004-340142A, includes fluid pressure chambers formed at one of a driving side rotational member and a driven side rotational member, and dividing portions, formed at the other one of the driving side rotational member and the driven side rotational member so as to divide the fluid pressure chambers into advanced angle chambers and retarded angle chambers. Supplying or discharging of a fluid relative to the advanced angle chambers or the retarded angle chambers is controlled, and thereby a relative rotational phase of the driven side rotational member relative to the driving side rotational member is controlled. According to JP2004-340142A, a spool valve controlling the supplying and discharging of the fluid relative to the advanced angle chambers or the retarded angle chambers, is arranged in a longitudinal direction of a camshaft so as to dispose the driving side rotational member and the driven side rotational member between the spool valve and the camshaft.

In order to improve controllability of the fluid relative to the advanced angle chambers and the retarded angle chambers, a length of the spool valve is sufficiently maintained so that an operational accuracy of the spool valve does not affect the controllability to a great extent. On the other hand, according to the valve timing control apparatus disclosed in JP2004-340142A, the spool valve is arranged in parallel with the longitudinal direction of the camshaft. Therefore, when the length of the spool valve is sufficiently maintained, a longitudinal length of the valve timing control apparatus is elongated, and mountability on an engine may be deteriorated.

A need thus exists for a valve timing control apparatus, which is not susceptible to the drawback mentioned above.

SUMMARY

According to an aspect of this disclosure, a valve timing control apparatus includes a driving side rotational member rotating synchronously with a crankshaft of an internal combustion engine, a driven side rotational member arranged coaxially with the driving side rotational member and rotating synchronously with a camshaft for opening and closing a valve of the internal combustion engine, a fluid pressure chamber formed at one of the driving side rotational member and the driven side rotational member, a dividing portion formed at the other one of the driving side rotational member and the driven side rotational member so as to divide the fluid pressure chamber into an advanced angle chamber and a retarded angle chamber, and a fluid control valve portion arranged orthogonally relative to the camshaft at an opposite side of the camshaft so as to dispose the driving side rotational member and the driven side rotational member between the fluid control valve portion and the camshaft, the fluid control valve portion including a first linearly moving member linearly moving in an orthogonal direction relative to the camshaft, thereby controlling supplying and discharging of a fluid relative to the advanced angle chamber and the retarded angle chamber.

According to a further aspect of this disclosure, a valve timing control apparatus includes a driving side rotational member rotating synchronously with a crankshaft of an internal combustion engine, a driven side rotational member arranged coaxially with the driving side rotational member and rotating synchronously with a camshaft for opening and closing a valve of the internal combustion engine, a fluid pressure chamber formed at one of the driving side rotational member and the driven side rotational member, a dividing portion formed at the other one of the driving side rotational member and the driven side rotational member so as to divide the fluid pressure chamber into an advanced angle chamber and a retarded angle chamber, and a fluid control valve portion extending in a radial direction of the driving side rotational member and the driven side rotational member, arranged at an opposite side of the camshaft so as to dispose the driving side rotational member and the driven side rotational member between the fluid control valve portion and the camshaft, and including a linearly moving member at an inside of the fluid control valve portion, the linearly moving member controlling supplying and discharging of a fluid relative to the advanced angle chamber and the retarded angle chamber.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

[Entire Configuration]

Figure 1:
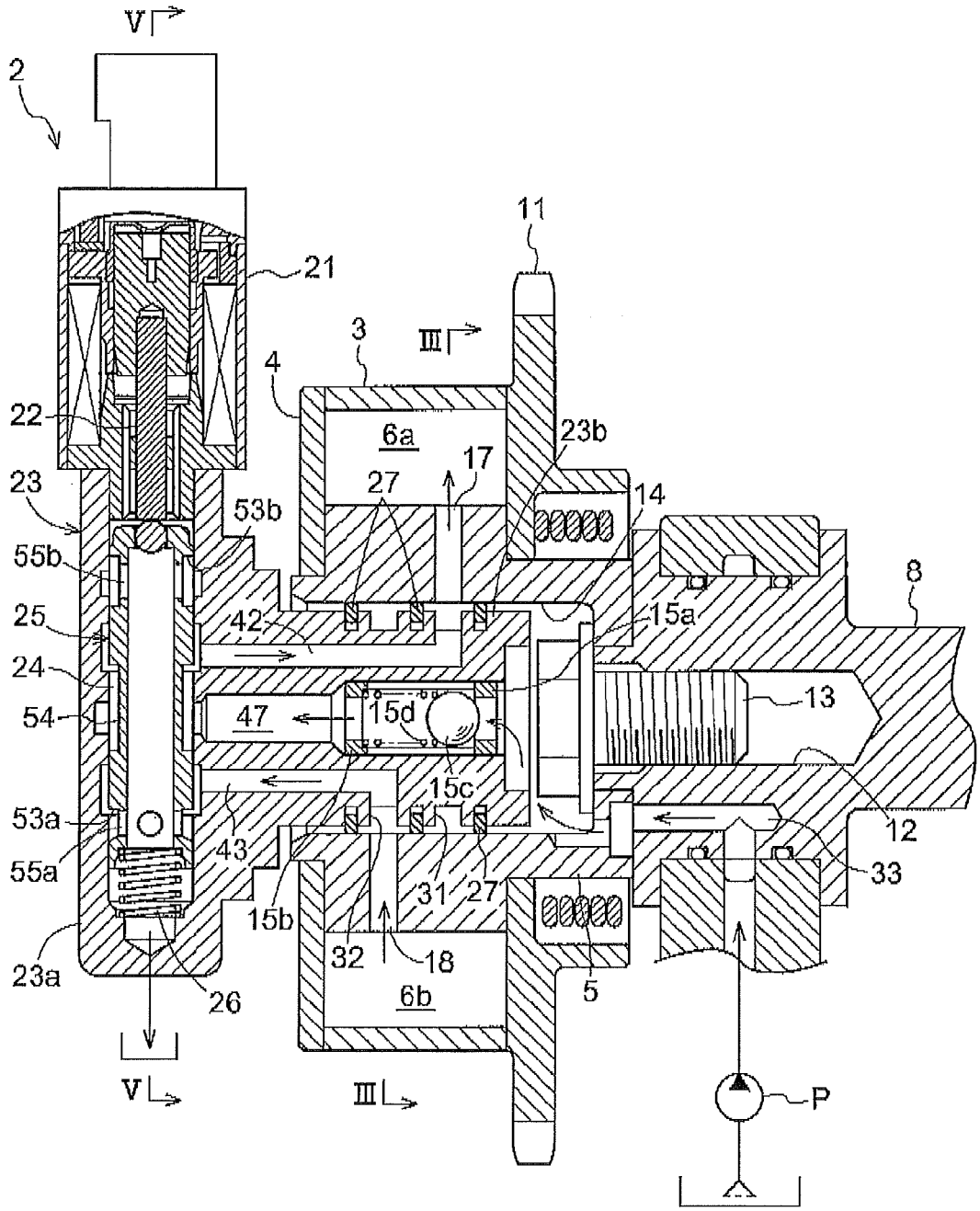
FIG. 1 is a cross-sectional view illustrating a valve timing control apparatus taken along a direction of a rotational axis when a first solenoid is not energized.

A valve timing control apparatus 1 according to an embodiment includes, as illustrated in FIG. 1, an outer rotor 3 (a driving side rotational member), a front plate 4 and an inner rotor 5 (a driven side rotational member). The outer rotor 3 and the front plate 4 rotate synchronously with a crankshaft of an engine. The inner rotor 5 is arranged coaxially with the outer rotor 3. The outer rotor 3 rotates synchronously with a camshaft 8 for opening and closing a valve of the engine.

The inner rotor 5 is integrally provided to an end portion of the camshaft 8, which configures a rotational shaft of a cam for controlling opening and closing of an intake valve and an exhaust valve of the engine. A recessed portion 14 is formed at a radially inner side of the inner rotor 5 (a side of an axis of the camshaft 8) so as to open toward an opposite side of the camshaft 8 (so as to open to face the front plate 4). Further, a fixing hole 12 is formed at a bottom portion of the inner rotor 5 so that the fixing hole 12 extends through the bottom portion of the inner rotor 5 toward the camshaft 8. A bolt 13 is inserted into the fixing hole 12 so that the inner rotor 5 is fixed to the camshaft 8. The camshaft 8 is rotationally provided at a cylinder head of the engine.

The outer rotor 3 and the front plate 4, which is integrally provided with the outer rotor 3, are provided so as to surround the inner rotor 5 so as to be rotatable relative to the inner rotor 5 within a predetermined range. A sprocket portion 11 is formed at an outer circumferential surface of the outer rotor 3. A power transmitting member, such as a timing chain or a timing belt, extend between the sprocket portion 11 and the gear attached to the crankshaft of the engine.

When the crankshaft of the engine is driven to rotate, a rotational torque is transmitted to the sprocket portion 11 via the power transmitting member, and thereby the outer rotor 3 is driven to rotate. Then, in accordance with the rotational driving of the outer rotor 3, the inner rotor 5 is driven to rotate, and thereby the camshaft 8 is rotated. Consequently, the cam, provided at the camshaft 8, thrusts down the intake valve or the exhaust valve of the engine so as to open the intake valve and the exhaust valve.

Figure 3:
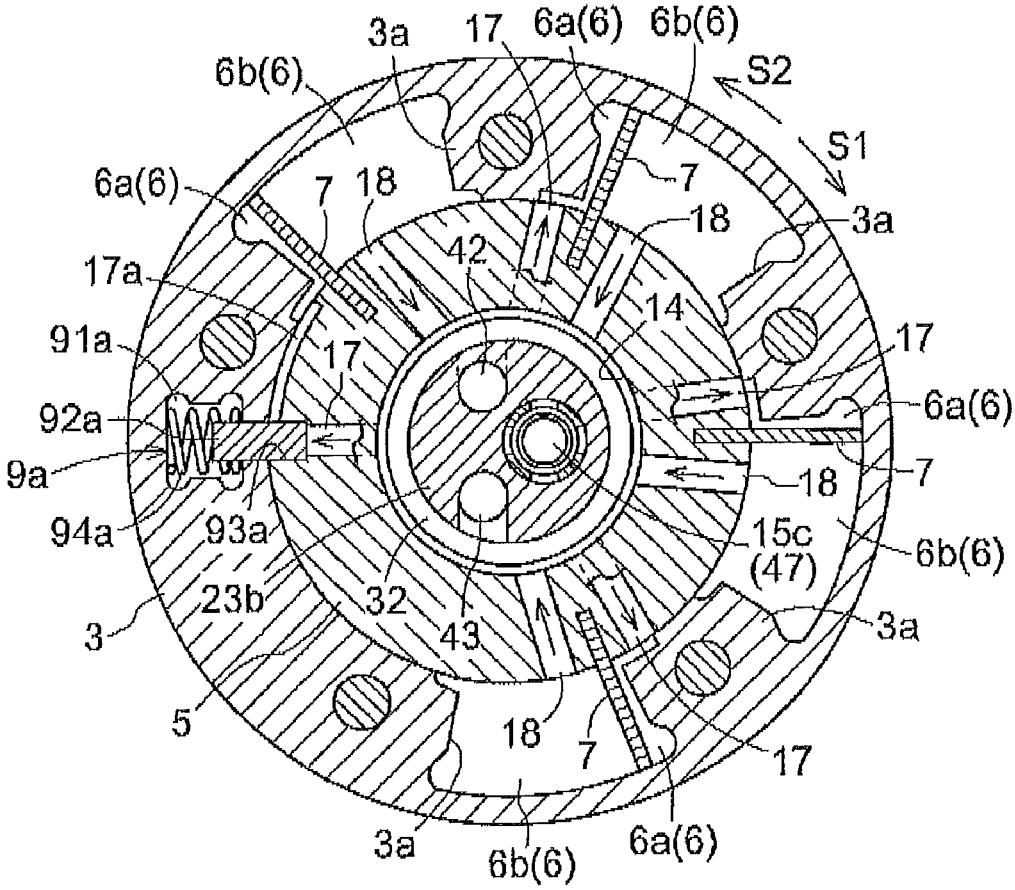
FIG. 3 is a cross-sectional view taken along line III-III in FIG. 1.

As illustrated in FIG. 3, a plurality of protruding portions, protruding in a radially inner direction of the outer rotor 3, are formed at the outer rotor 3 along a circumferential direction of the outer rotor 3 so as to include an interval between adjacent protruding portions. Fluid pressure chambers 6 are formed at the outer rotor 3 at a portion defined by the inner rotor 5 and adjacent protruding portions. Four fluid pressure chambers 6 are provided according to the embodiment.

Grooves are formed at a radially outer portion of the inner rotor 5 so as to respectively face the fluid pressure chambers. Vanes (a dividing portion) 7 are inserted into the corresponding grooves. Each of the fluid pressure chambers 6 is divided into an advanced angle chamber 6*a* and a retarded angle chamber 6*b* by the vane 7 in a direction of relative rotation of the inner rotor 5 and the outer rotor 3 (i.e., in directions shown by arrows S1 and S2 in FIGS. 3 and 4).

Advanced angle chamber communication holes 17 and retarded angle chamber communication holes 18 are formed at the inner rotor 5. The recessed portion 14 and each of the advanced angle chambers 6*a* communicate with each other via each of the advanced angle chamber communication holes 17. The recessed portion 14 and each of the retarded angle chambers 6*b* communicate with each other via each of the retarded angle chamber communication holes 18.

When an operational oil (fluid) in a hydraulic pulp P is supplied to or discharged from the advanced angle chambers 6*a* and the retarded angle chambers 6*b*, a relative rotational phase between the inner rotor 5 and the outer rotor 3 (which will be referred to as a "relative rotational phase" hereinafter) is displaced in an advanced angle direction S1 or in a retarded angle direction S2. The advanced angle direction S1 is a direction in which the vanes 7 are displaced relative to the fluid pressure chambers 6 in a direction shown by the arrow S1 in FIGS. 3 and 4. The retarded angle direction S2 is a direction in which the vanes 7 are displaced relative to the fluid pressure chambers 6 in a direction shown by the arrow S2 in FIGS. 3 and 4.

When the operational oil is supplied to the advanced angle chambers 6*a*, the relative rotational phase is displaced in the advanced angle direction S1. When the operational oil is supplied to the retarded angle chambers 6*b*, the relative rotational phase is displaced in the retarded angle direction S2. A displacable range of the relative rotational phase is a range in which the vanes 7 are displacable within the corresponding fluid pressure chambers 6. The displacable range of the relative rotational phase corresponds to a range between a most retarded angle phase, in which a volume of each of the retarded angle chambers 6*b* becomes largest, and a most advanced angle phase, in which a volume of each of the advanced angle chambers 6*a* becomes largest.

A fluid supplying passage 33, to which the operational oil is supplied from the hydraulic pump P, is formed at the camshaft 8 so as to extend in a longitudinal direction of the camshaft 8. The fluid supplying passage 33 communicates with the recessed portion 14 at one end of the fluid supplying passage 33 while the other end of the fluid supplying passage 33 is supplied with the operational oil from the hydraulic pump P. The operational oil, supplied to the fluid supplying passage 33, is then supplied to the advanced angle chambers 6*a* or the retarded angle chambers 6*b* via a fluid control valve mechanism (a fluid control valve portion) 2 (described later).

A lock mechanism 9*a* is provided between the outer rotor 3 and the inner rotor 5. The relative rotational phase between the outer rotor 3 and the inner rotor 5 is fixable at a predetermined phase by means of the lock mechanism 9*a*. According to the embodiment, the relative rotational phase is set to be fixable at a most retarded angle by means of the lock mechanism 9*a*. The lock mechanism 9*a* includes an accommodating portion 91*a*, an advancing and retracting member 92*a*, an engagement recessed portion 93*a* and a first spring 94*a*. The accommodating portion 91*a* is formed at the outer rotor 3. The engagement recessed portion 93*a* is formed at the inner rotor 5. The advancing and retracting member 92*a* is displacable between a locked state, in which the advancing and retracting member 92*a* advances into the engagement recessed portion 93*a*, and a lock released state, in which the advancing and retracting member 92*a* retracts into the accommodating portion 91*a*. The advancing and retracting member 92*a* is normally biased so as to advance into the engagement recessed portion 93*a* by means of the first spring 94*a*, provided at the accommodating portion 91*a*.

The engagement recessed portion 93*a* communicates with one of the advanced angle chamber communication holes 17. When the operational fluid is supplied to the engagement recessed portion 93*a* via the advanced angle chamber communication hole 17, the advancing and retracting member 92*a* retracts from the engagement recessed portion 93*a* against a biasing force of the first spring 94*a* by means of a hydraulic pressure, thereby changing to the lock released state. On the other hand, when the operational oil is discharged from the engagement recessed portion 93*a*, the advancing and retracting member 92*a* advances into the engagement recessed portion 93*a* by means of the biasing force of the first spring 94*a*, thereby changing to the locked state. Consequently, when the engine is started, backlash is less likely to occur at the inner rotor 5 and the vanes 7, which are positioned at the most retarded angle, due to torque fluctuation.

An advanced angle groove portion 17*a* is formed at the inner rotor 5 along a sliding surface of the inner rotor 5 and the outer rotor 3 so that the engagement recessed portion 93*a* and one of the advanced angle chambers 6*a*, which is positioned to be closest to the lock mechanism 9*a* among four advanced angle chambers 6*a*, communicate with each other. The operational oil is supplied from the advanced angle chamber communication hole 17*a* to one of the advanced angle chambers 6*a* via the advanced angle chamber groove portion 17*a*.

[Fluid Control Valve Mechanism]

The operational oil is supplied to or discharged from the advanced angle chambers 6*a* and the retarded angle chambers 6*b* by means of the fluid control valve mechanism 2. The fluid control valve mechanism 2 is relatively rotatably inserted into the recessed portion 14 of the inner rotor 5, and is fixed to a stationary member, such as a front cover of the engine. In other words, the fluid control valve mechanism 2 is stationary and does not follow the rotation of the inner rotor 5.

The fluid control valve mechanism 2 includes, as illustrated in FIG. 1, a first solenoid 21, a housing 23 and a spool valve 25 (a first linearly moving member, a linearly moving member). The spool valve 25 is formed into a substantially cylindrical shape, which is provided with bottom surfaces at ends thereof, respectively. The housing 23 includes a spool valve accommodating portion 23*a*, accommodating the spool valve 25, and a protruding portion 23*b*, inserted into the recessed portion 14 of the inner rotor 5. The spool valve accommodating portion 23*a* is formed with a first hollow portion 24, within which the spool valve 25 is accommodated. The first hollow portion 24 is formed into a substantially cylindrical shape, which is provided with a bottom surface at one end and an opening at the other end. The protruding portion 23*b* is formed into a substantially cylindrical shape, which fits in a shape of the recessed portion 14. The first hollow portion 24 of the spool valve accommodating portion 23*a* and the protruding portion 23*b* extends orthogonally relative to each other. The spool valve 25 is accommodated within the first hollow portion 24 so as to be movable in an orthogonal direction to a rotational axis of the camshaft 8.

As illustrated in FIG. 1, the protruding portion 23*b* of the housing 23 is relatively rotatably inserted into the recessed portion 14 of the inner rotor 5. Further, the housing 23 is fixed to the front cover of the engine and the like. Consequently, the inner rotor 5 is relatively rotatably supported by the protruding portion 23*b*.

A second spring 26 is provided between the spool valve 25 and the bottom surface of the first hollow portion 24. The spool valve 25 is biased toward the opening of the first hollow portion 24 by means of the second spring 26. The first solenoid 21 is provided at the opening end of the spool valve accommodating portion 23*a* so that the first solenoid 21 reciprocates the spool valve 25 in the orthogonal direction to the rotational axis of the camshaft 8. An end portion of a first rod 22, provided to the first solenoid 21, contacts a bottom portion of the spool valve 25. When the first solenoid 21 is energized, as illustrated by the difference between FIGS. 1 and 2, the first rod 22 thrusts the bottom portion of the spool valve 25 while projecting from the first solenoid 21, and thereby the spool valve 25 is moved in a lower direction in FIGS. 1 and 2. When an energization of the first solenoid 21 is stopped, the first rod 22 is retracted toward a side of the first solenoid 21, and in accordance with the movement of the first rod 22, the spool valve 25 is moved toward the side of the first solenoid 21 by means of a biasing force of the second spring 26. The fluid control valve portion is configured by the first solenoid 21, the first rod 22, the spool valve 25 and the second spring 26.

Figure 2:
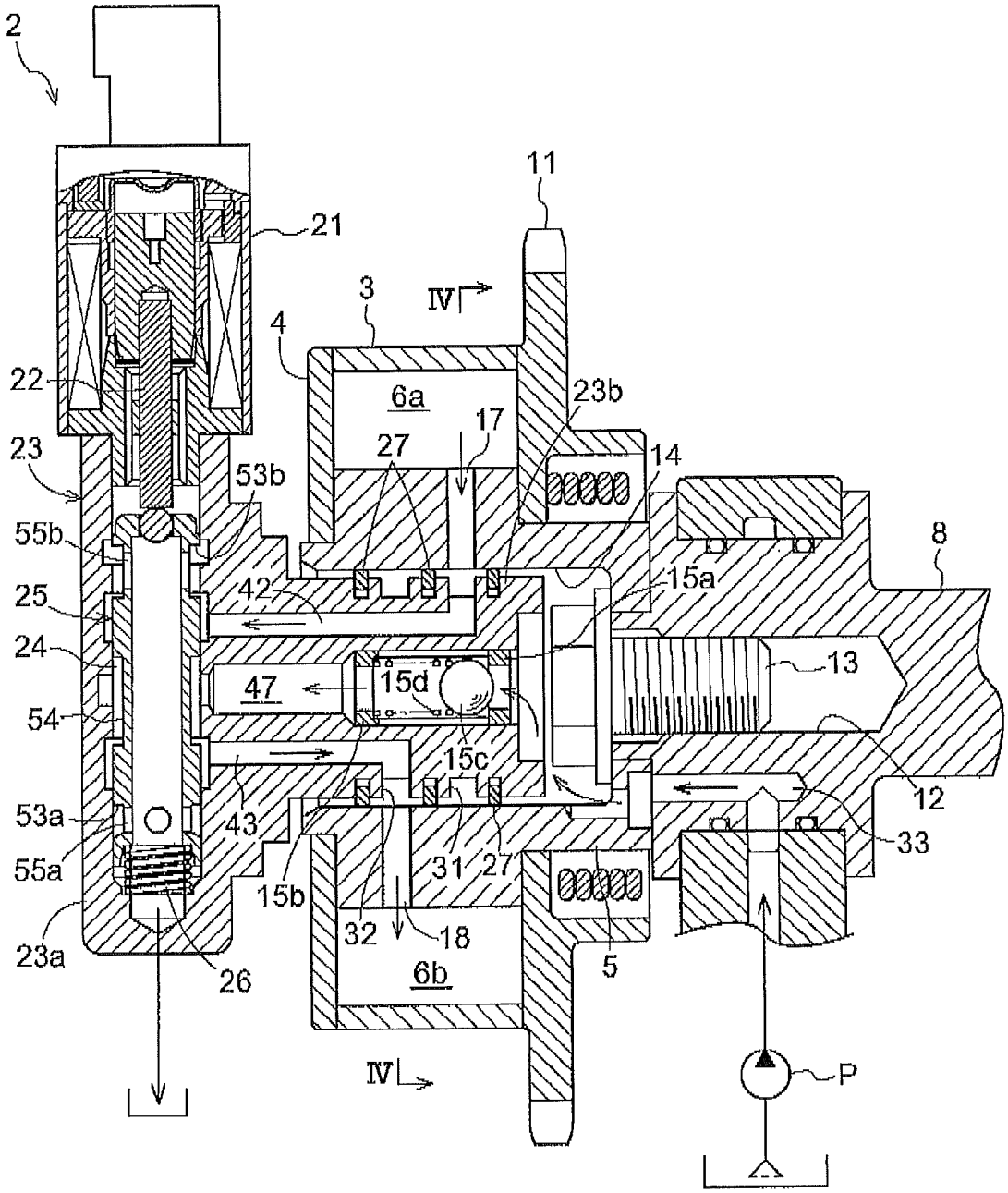
FIG. 2 is a cross-sectional view illustrating the valve timing control taken along the direction of the rotational axis when the first solenoid is energized.

Three grooves, each of which is formed into a ring shape, are formed around an outer circumferential surface of the protruding portion 23*b* so as to be in parallel with each other. Seals 27 are respectively provided at the grooves so that the operational oil does not leak. An advanced angle outer circumferential groove 31 and a retarded angle outer circumferential groove 32 are respectively formed at portions between the adjacent grooves. Leaking of the operational oil from the advanced angle outer circumferential groove 31 and the retarded angle outer circumferential groove 32 is restricted by means of the seals 27. As illustrated in FIGS. 1 and 2, the advanced angle outer circumferential groove 31 communicates with the advanced angle chamber communication holes 17 while the retarded angle outer circumferential groove 32 communicates with the retarded angle chamber communication holes 18.

As illustrated in FIGS. 1 and 2, a supply side fluid passage 47, an advanced angle side fluid passage 42 and a retarded angle side fluid passage 43, each of which extends in a longitudinal direction of the protruding portion 23*b* (i.e., a longitudinal direction of the camshaft 8), are formed at an inside of the protruding portion 23*b*. One longitudinal end of the supply side fluid passage 47 opens toward an end of the protruding portion 23*b* opposite from the spool valve accommodating portion 23*a* while the other longitudinal end of the supply side fluid passage 47 opens toward the first hollow portion 24. A first sleeve 15*a* and a second sleeve 15*b* are provided at an intermediate portion of the supply side fluid passage 47 in a longitudinal direction thereof. A first spherical valve body 15*c* (a check valve) is provided between the first and second sleeves 15*a* and 15*b*. A third spring 15*d* is provided between the first spherical valve body 15*c* and the second sleeve 15*b*, which is provided at a downstream side of the supply side fluid passage 47 so that the first spherical valve body 15*c* is biased toward an upstream side of the supply side fluid passage 47. Consequently, the first spherical valve body 15*c* restricts a flow of the operational oil from the supply side fluid passage 47 toward a side of the recessed portion 14. One longitudinal end of the advanced angle side fluid passage 42 opens toward the first hollow portion 24 while the other longitudinal end of the advanced angle side fluid passage 42 opens toward the advanced angle outer circumferential groove 31. One longitudinal end of the retarded angle side fluid passage 43 opens toward the first hollow portion 24 while the other longitudinal end of the retarded angle side fluid passage 43 opens toward the retarded angle outer circumferential groove 32. Further, the advanced angle side fluid passage 42 configures the advanced angle outer circumferential groove 31. Furthermore, the retarded angle side fluid passage 43 configures the retarded angle outer circumferential groove 32.

Figure 5:
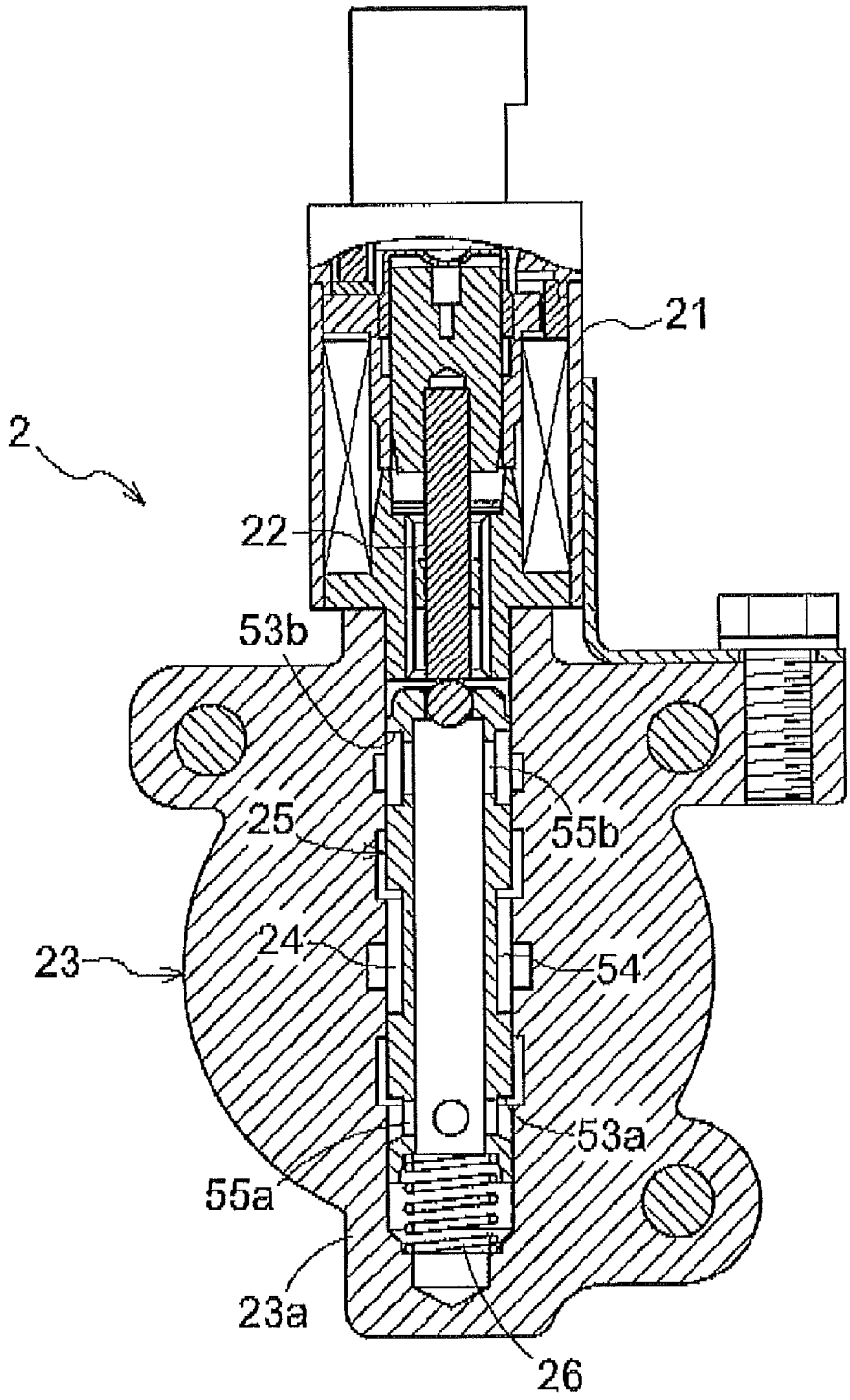
FIG. 5 is a cross-sectional view taken along line V-V in FIG. 5.
Figure 6:
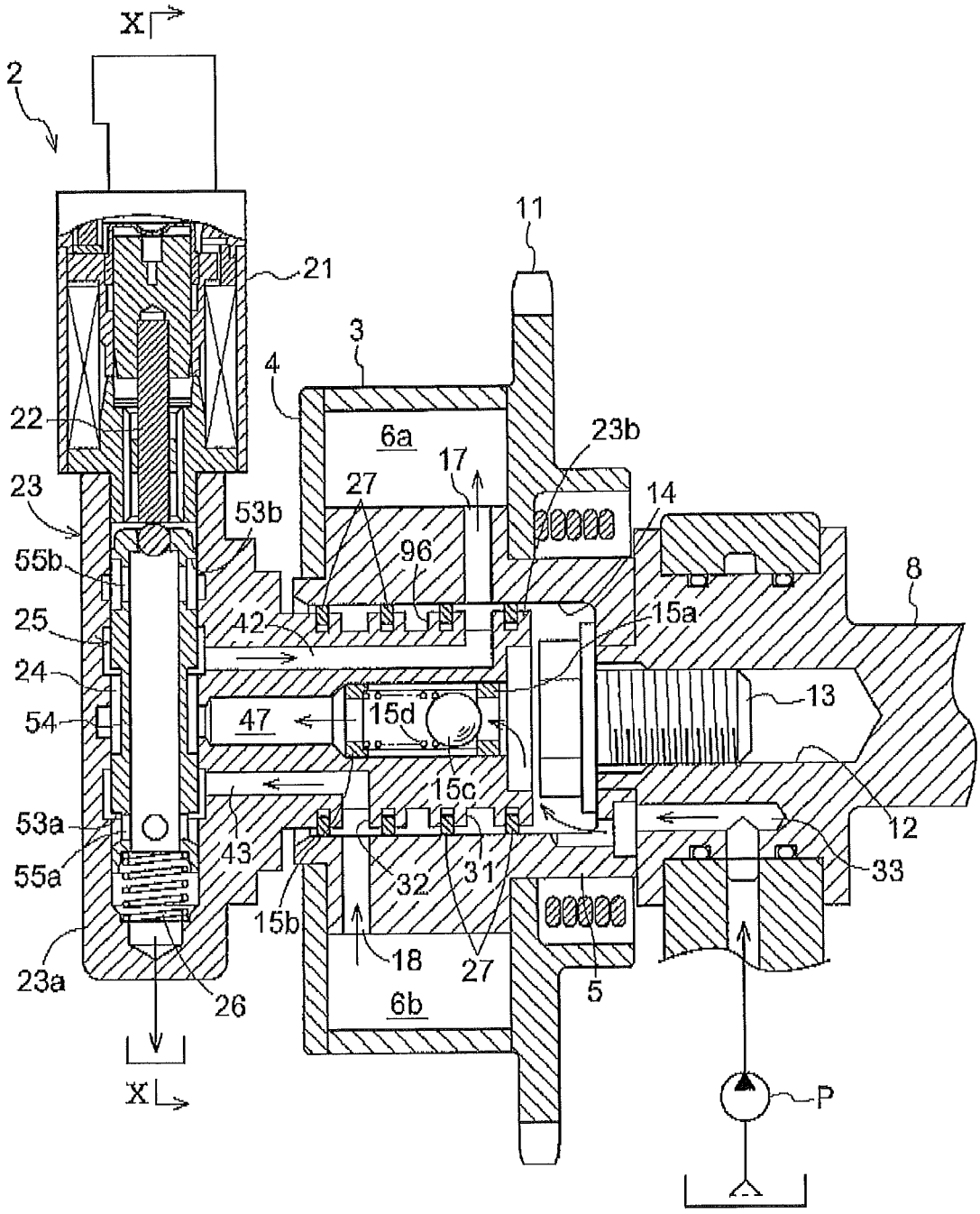
FIG. 6 is a cross-sectional view illustrating a valve timing control apparatus according to a modified embodiment taken along a direction of a rotational axis.

As illustrated in FIGS. 1, 2 and 5, a first discharging outer circumferential groove 53*a*, a second discharging outer circumferential groove 53*b* and a supplying outer circumferential groove 54, each of which is formed into a substantially cylindrical shape, are formed at an outer circumferential surface of the spool valve 25. A first through-hole 55*a* and a second through-hole 55*b*, each of which extends through the spool valve 25 into the first hollow portion 24, are respectively formed at the first discharging outer circumferential groove 53*a* and the second discharging outer circumferential groove 53*b*.

When the first solenoid 21 is not energized, as illustrated in FIG. 1, the first and second discharging outer circumferential grooves 53*a* and 53*b* and the supplying outer circumferential groove 54 are positioned so that the supply side fluid passage 47 and the advanced angle side fluid passage 42 communicate with each other via the supplying outer circumferential groove 54, and so that the first discharging outer circumferential groove 53*a* and the retarded angle side fluid passage 43 communicate with each other. Further, when the first solenoid 21 is energized, the first and second discharging outer circumferential grooves 53*a* and 53*b* and the supplying outer circumferential groove 54 are positioned so that the supply side fluid passage 47 and the retarded angle side fluid passage 43 communicate with each other via the supplying outer circumferential groove 54, and so that the second discharging outer circumferential groove 53*b* and the advanced angle side fluid passage 42 communicate with each other.

[Operation of Valve Timing Control Apparatus]

An operation of the valve timing control apparatus 1 will be described hereinafter with reference to the attached drawings.

As illustrated in FIG. 1, in order to supply the operational oil to the advanced angle chambers 6*a* so as to displace the relative rotational phase in the advanced angle direction S1, the first solenoid 21 is not energized so as to be in a non-energized state. When the first solenoid 21 is in the non-energized state, the spool valve 25 is moved toward the side of the first solenoid 21 together with the first rod 22 of the first solenoid 21 by means of the spring force of the second spring 26. In the non-energized state of the first solenoid 21, when the operational oil is supplied from the hydraulic pump P to the fluid supplying passage 33, formed at the camshaft 8, as illustrated in FIGS. 1 and 3, the operational oil flows from the fluid supplying passage 33 through the recessed portion 14, the supply side fluid passage 47, the supplying outer circumferential groove 54, the advanced angle side fluid passage 42, the advanced angle outer circumferential groove 31 and the advanced angle chamber communication holes 17, thereby being pressure-transmitted to each of the advanced angle chambers 6*a*. Consequently, the vanes 7 are moved relative to the fluid pressure chambers 6 in the advanced angle direction S1, and thereby the operational oil is discharged from the retarded angle chambers 6*b*. The operational oil, discharged from the retarded angle chambers 6*b*, flows through the corresponding retarded angle chamber communication holes 18, the retarded angle outer circumferential groove 32, the retarded angle side fluid passage 43, the first discharging outer circumferential groove 53*a*, the first through-hole 55*a* and a drain fluid passage, thereby being discharged to an outside of the valve timing control apparatus 1.

Figure 4:
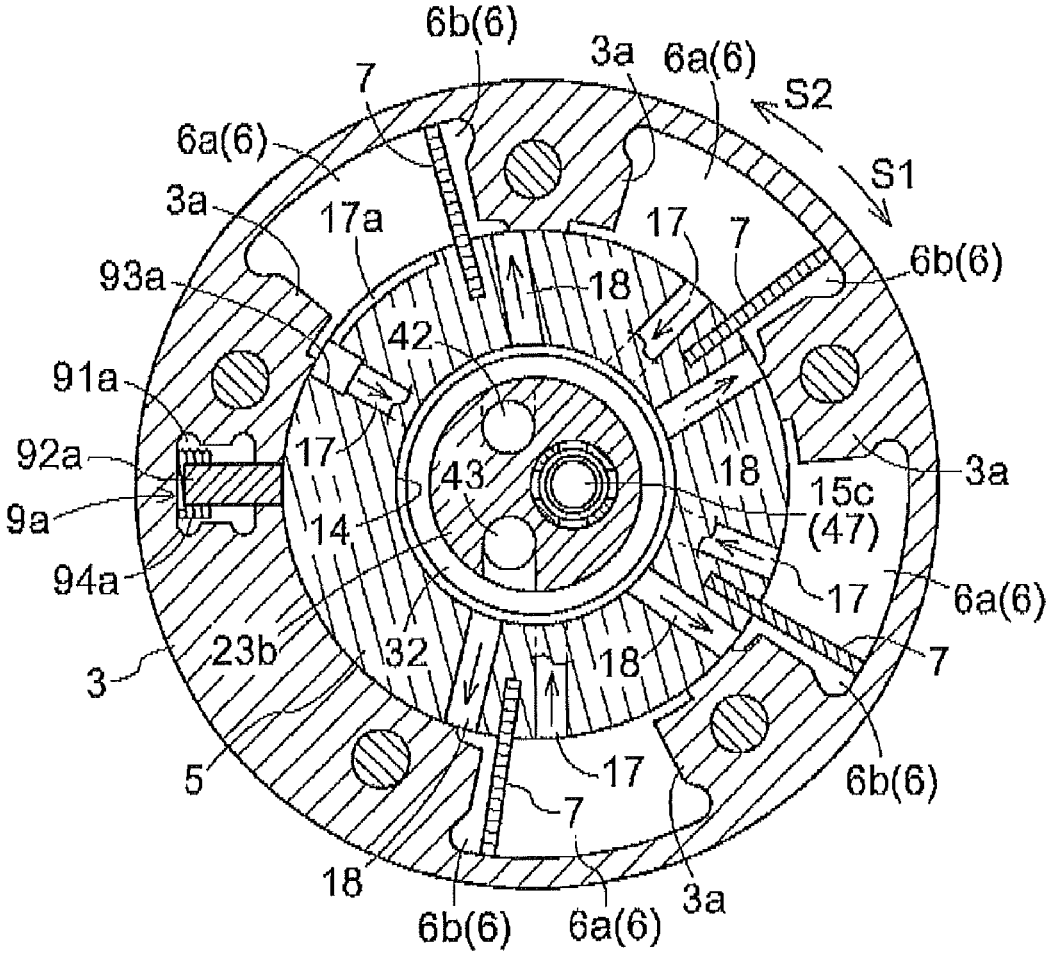
FIG. 4 is a cross-sectional view taken along line IV-IV in FIG. 2.

On the other hand, in order to supply the operational oil to the retarded angle chambers 6*b* so as to displace the relative rotational phase in the retarded angle direction S2, the first solenoid 21 is energized so as to be in an energized state. When the first solenoid 21 is in the energized state, the spool valve 25 is thrust by means of the first rod 22 of the first solenoid 21 so as to be moved downward in FIG. 2. In the energized state of the first solenoid 21, when the operational oil is supplied from the hydraulic pump P to the fluid supplying passage 33, formed at the camshaft 8, as illustrated in FIGS. 2 and 4, the operational oil flows from the fluid supplying passage 33 through the recessed portion 14, the supply side fluid passage 47, the supplying outer circumferential groove 54, the retarded angle side fluid passage 43, the retarded angle outer circumferential groove 32 and the retarded angle chamber communication holes 18, thereby being pressure-transmitted to each of the retarded angle chambers 6*b*. Consequently, the vanes 7 are moved relative to the fluid pressure chambers 6 in the retarded angle direction S2, and thereby the operational oil is discharged from the advanced angle chambers 6*a*. The operational oil, discharged from the advanced angle chambers 6*a*, flows through the corresponding advanced angle chambers communication holes 17, the advanced angle outer circumferential groove 31, the advanced angle side fluid passage 42, the second discharging outer circumferential groove 53*b*, the second through-hole 55*b* and the drain fluid passage, thereby being discharged to the outside of the valve timing control apparatus 1.

Modified Embodiment

A modified embodiment of the valve timing control apparatus 1 will be described hereinafter with reference to the attached drawings. According to the modified embodiment, the valve timing control apparatus 1 includes a phase displacement lock mechanism (a phase displacement regulating mechanism) 9*b* in addition to the lock mechanism 9*a*. Further, the fluid control valve mechanism 2 includes a lock fluid passage (a regulating passage) 99 for supplying and discharging the operational oil relative to the phase displacement lock mechanism 9*b*. Description of configurations similar to the above-described embodiment will not be repeated, and a similar configuration will be referred to with the same reference numerals.

Figure 8:
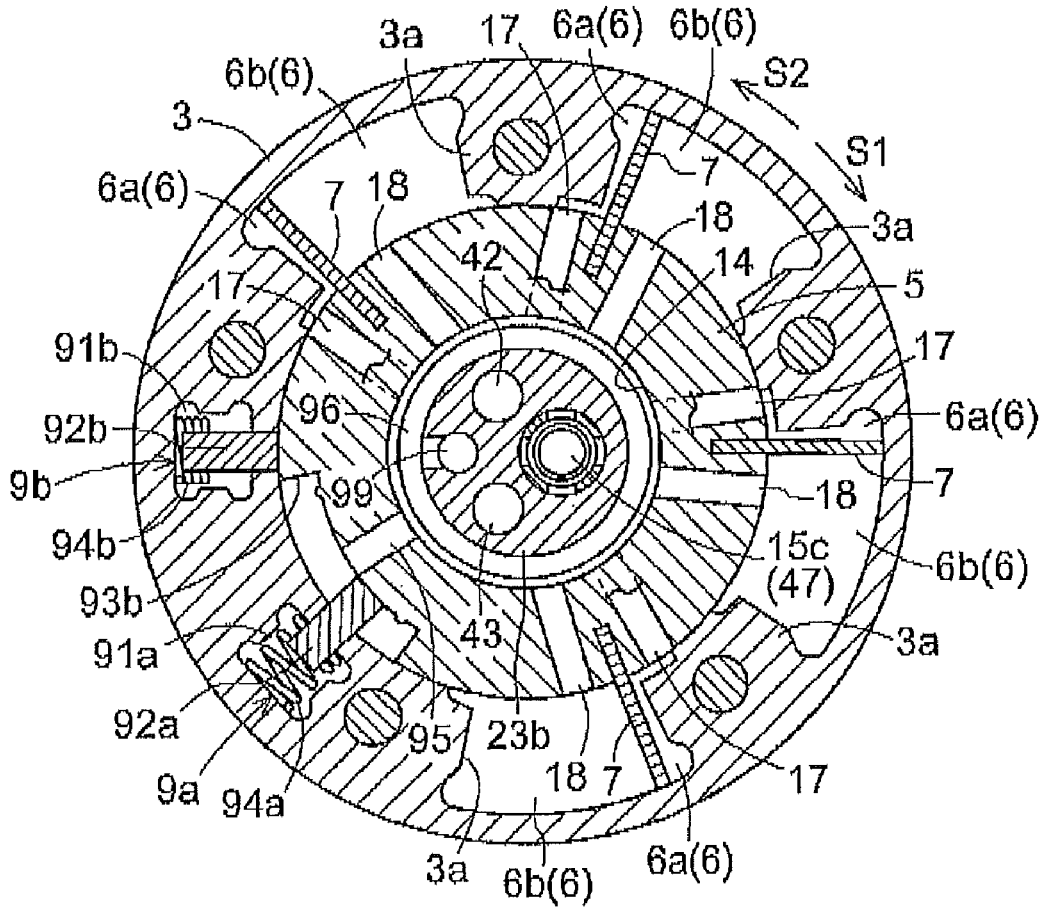
FIG. 8 is a cross-sectional view taken along line VIII-VIII in FIG. 7.
Figure 9:
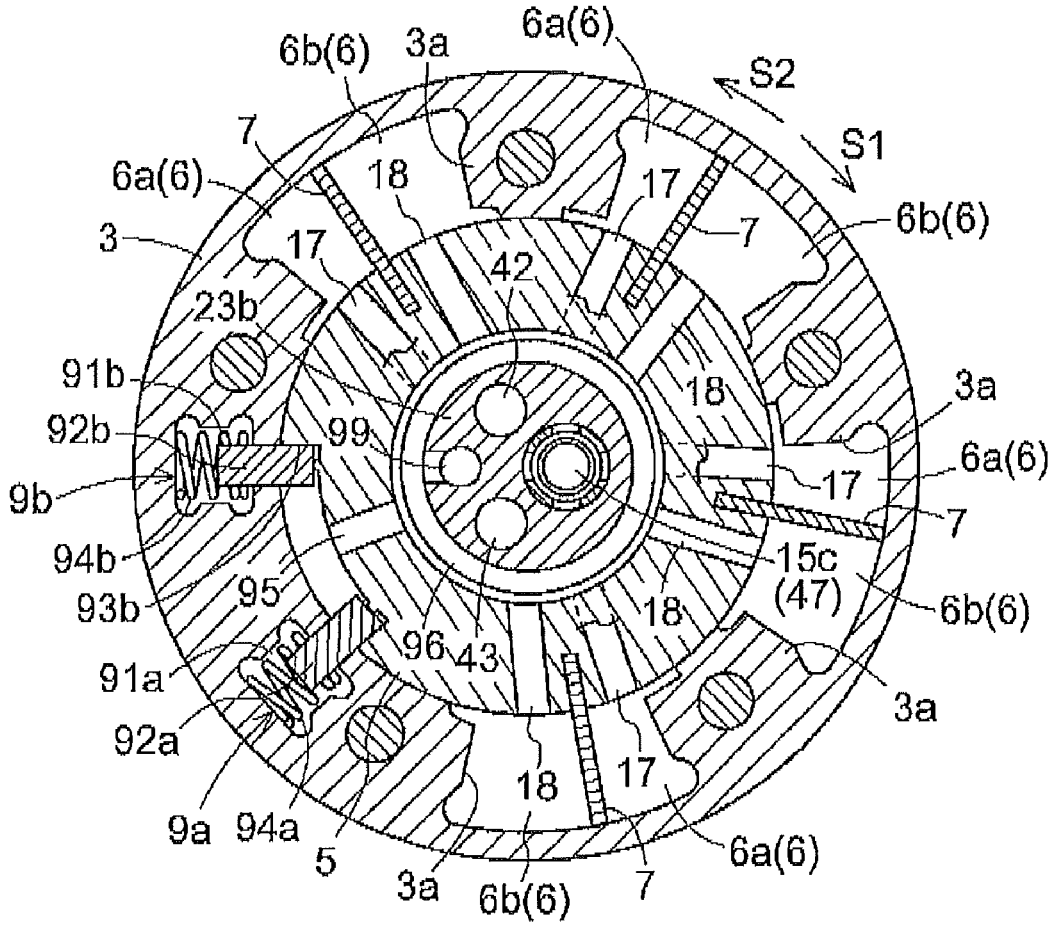
FIG. 9 is a cross-sectional view taken along line IX-IX in FIG. 7.

As illustrated in FIGS. 8 and 9, the phase displacement lock mechanism 9*b* is arranged between the inner rotor 5 and the outer rotor 3. The phase displacement lock mechanism 9*b* locks a displacement of the relative rotational phase at a predetermined phase so as to create a locked state, and releases the locking of the displacement of the relative rotational phase so as to create a released state. According to the modified embodiment, the displacement of the relative rotational phase is locked at an intermediate lock phase (see FIG. 9) between the most advanced angle phase and the most retarded angle phase by means of the phase displacement lock mechanism 9*b*.

The phase displacement lock mechanism 9*b* includes a lock accommodating portion 91*b*, a lock advancing and retracting member 92*b*, a lock recessed portion 93*b* and a fourth spring 94*b*. The lock accommodating portion 91*b* is formed at the outer rotor 3. The lock recessed portion 93*b* is formed at the inner rotor 5. The lock advancing and retracting member 92*b* is displaceable between the locked state, in which the advancing and retracting member 92*b* advances into the lock recessed portion 93*b*, and a released state, in which the lock advancing and retracting member 92*b* retracts into the lock accommodating portion 91*b*. The lock advancing and retracting member 92*b* is normally biased so as to advance into the lock recessed portion 93*b* by means of the fourth spring 94*b*, provided at the lock accommodating portion 91*b*.

Figure 7:
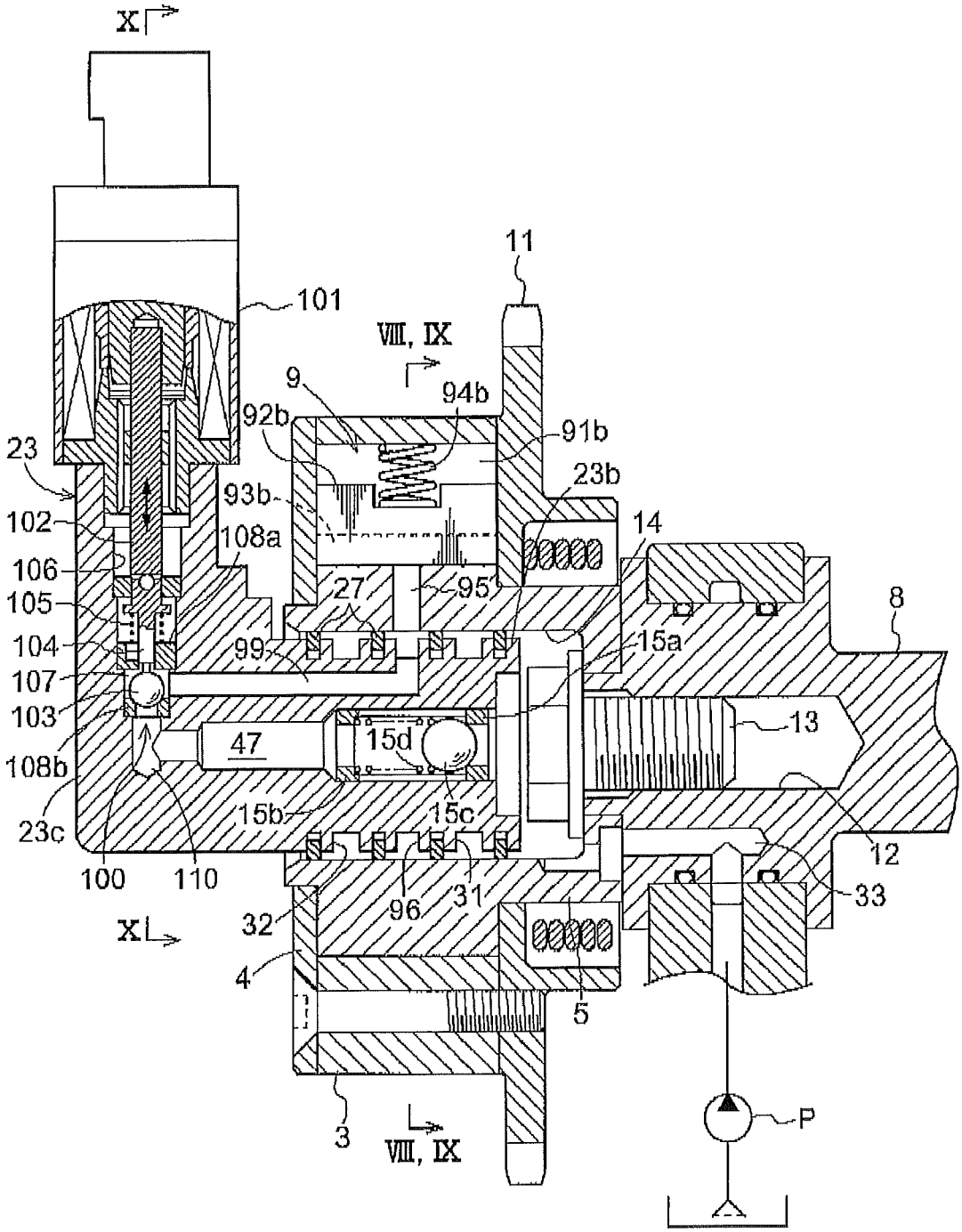
FIG. 7 is a cross-sectional view illustrating the valve timing control apparatus according to the modified embodiment taken along the direction of the rotational axis.
Figure 10:
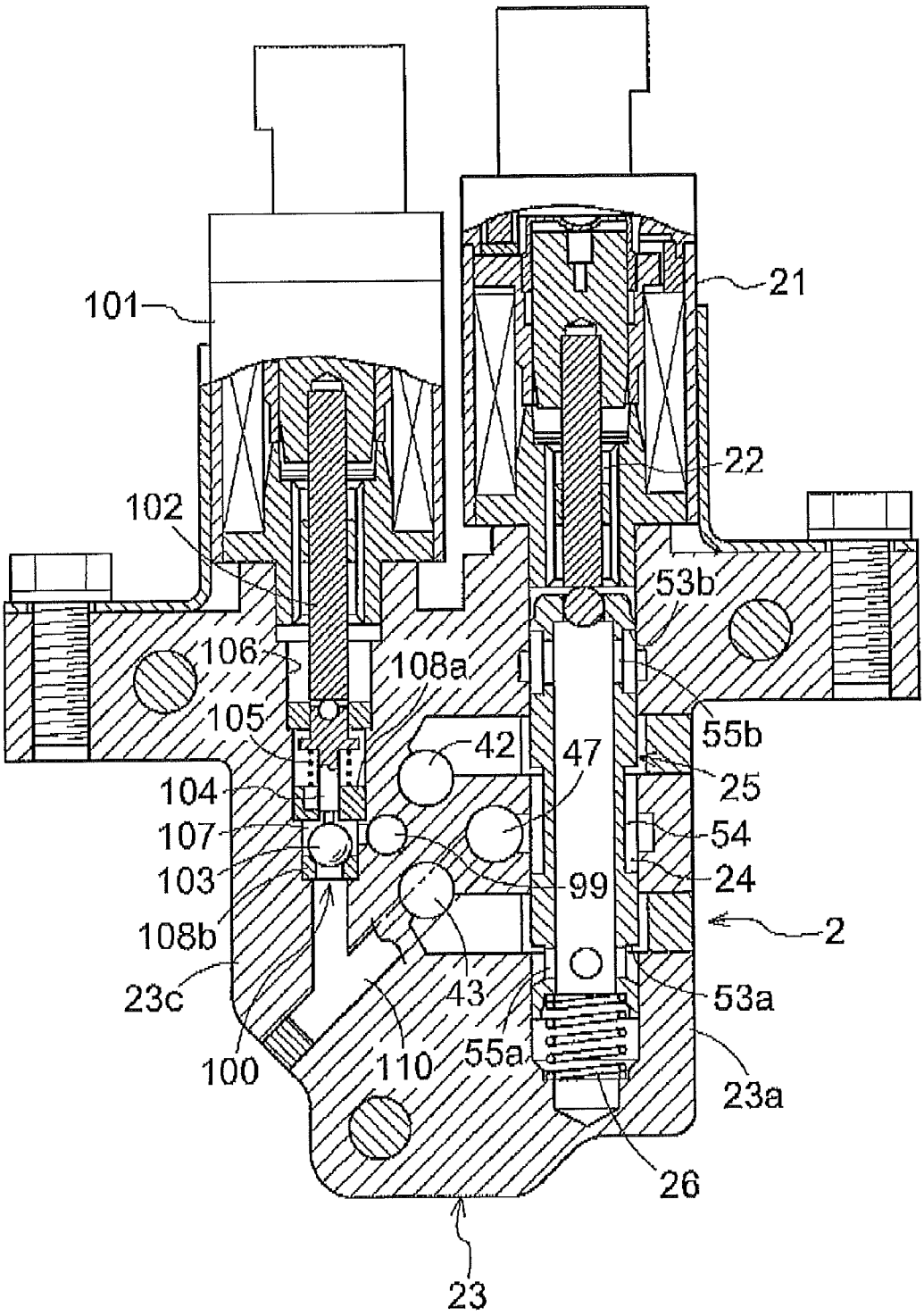
FIG. 10 is a cross-sectional view taken along line X-X in FIGS. 6 and 7.

According to the modified embodiment, as illustrated in FIGS. 7 and 10, the fluid control valve mechanism 2 includes a phase displacement lock valve portion 100 for controlling supplying and discharging of fluid relative to the phase displacement lock mechanism 9*b*, and a second solenoid 101 for operating the phase displacement lock valve portion 100. The phase displacement lock valve portion 100 includes a second spherical valve body 103 and an operating member 104.

As illustrated in FIGS. 7 and 8, the housing 23 includes a phase displacement lock valve accommodating portion 23*c* in addition to the spool valve accommodating portion 23*a* for accommodating the spool valve 25, and the protruding portion 23*b* inserted into the recessed portion 14. The phase displacement lock valve accommodating portion 23*c* is aligned with the spool valve accommodating portion 23*a* in the orthogonal direction to the longitudinal direction of the protruding portion 23*b* (i.e., the longitudinal direction of the camshaft 8). According to the modified embodiment, as illustrated in FIG. 10, the phase displacement lock valve accommodating portion 23*c* and the spool valve accommodating portion 23*a* are arranged to be in the same plane in the longitudinal direction of the protruding portion 23*b* (i.e., the longitudinal direction of the camshaft 8).

The phase displacement lock valve accommodating portion 23*c* is formed with a second hollow portion 106, within which the phase displacement lock valve portion 100 is accommodated. The second hollow portion 106 is formed into a substantially cylindrical shape, which is provided with a bottom surface at one end and an opening at the other end. The second hollow portion 106 extends in the orthogonal direction to the longitudinal direction of the protruding portion 23*b* (i.e., the longitudinal direction of the camshaft 8). A bottom portion of the second hollow portion 106 is divided by means of a third sleeve 108*a* and a fourth sleeve 108*b*. An area surrounded by the third sleeve 108*a* and the fourth sleeve 108*b* serves as a valve spaced portion 107, within which the second spherical valve body 103 is arranged. The operating member 104 (a second linearly moving member) is arranged at an upper portion of the third sleeve 108*a* in FIGS. 7 and 10. A fifth spring 105 is arranged between the operating member 104 and the third sleeve 108*a* so that the operating member 104 is biased toward a side of the second solenoid 101 (in an upper direction in FIGS. 7 and 10) (described later).

The second solenoid 101 is provided at an opening end of the phase displacement lock valve accommodating portion 23*c* so that second solenoid 101 reciprocates the operating member 104 in the orthogonal direction to the rotational axis of the camshaft 8. An end portion of a second rod 102, provided to the second solenoid 101, contacts the operating member 104. When the second solenoid 101 is energized, the second rod 102 thrusts the operating member 104 while projecting from the second solenoid 101, and thereby the operating member 104 is moved downward in FIG. 7. Consequently, the second spherical valve body 103 is thrust toward the third and fourth sleeves 108*a* and 108*b*, thereby blocking communication. When an energization of the second solenoid 101 is stopped, the second rod 102 is retracted toward a side of the second solenoid 101, and in accordance with the movement of the second rod 102, the operating member 104 is moved toward the side of the second solenoid 101 by means of a biasing force of the fifth spring 105. Accordingly, the thrusting of the second spherical valve body 103 by means of the operating member 104 is released. The phase displacement lock valve portion 100 is configured by the second solenoid 101, the second rod 102, the second spherical valve body 103, the operating member 104 and the fifth spring 105.

As illustrated in FIGS. 8 and 7, four grooves, each of which is formed into a ring shape, are formed around the outer circumferential surface of the protruding portion 23*b* so as to be in parallel with each other. The seals 27 are respectively provided at the grooves so that the operational oil does not leak from the grooves. In addition to the advanced angle outer circumferential groove 31 and the retarded angle outer circumferential groove 32, a lock outer circumferential groove 96 is formed at a portion between the adjacent grooves. The lock outer circumferential groove 96 communicates with a lock communication hole 95, which is connected to the lock recessed portion 93*b*.

As illustrated in FIGS. 7 and 10, in addition to the supply side fluid passage 47, the advanced angle side fluid passage 42 and the retarded angle side fluid passage 43, a lock fluid passage 99 is formed at the inside of the protruding portion 23*b*. One longitudinal end of the lock fluid passage 99 opens toward the valve spaced portion 107 while the other longitudinal end of the lock fluid passage 99 communicates with the lock outer circumferential groove 96. Further, the lock fluid passage 99 configures the lock outer circumferential groove 96. A connecting fluid passage 110 is provided so as to connect the supply side fluid passage 47 and the lock fluid passage 99. One longitudinal end of the connecting fluid passage 110 communicates with the supply side fluid passage 47 while the other longitudinal end of the connecting fluid passage 110 opens toward the valve spaced portion 107.

In order to supply the operational oil to the lock mechanism 9*a* and the phase displacement lock mechanism 9*b* so as to release the lock by means of the phase displacement lock mechanism 9*b*, the second solenoid 101 is started to be energized. Consequently, the operational oil flows from the hydraulic pump P through the fluid supplying passage 33, the supply side fluid passage 47, the connecting fluid passage 110, the valve spaced portion 107, the lock fluid passage 99, the lock outer circumferential grove 96 and the lock communication hole 95, thereby being pressure-transmitted to the lock recessed portion 93*b*. When a pressure of the operational oil reaches a predetermined level, the second advancing and retracting member 92*b* retracts from the lock recessed portion 93*b*, thereby changing to the released state. Subsequently, the relative rotational phase may be controlled in a manner where the operational oil is supplied to or discharged from the advanced angle chambers 6*a* or the retarded angle chambers 6*b*.

The valve timing control apparatus 1 according to the above-described embodiments may be applied to an internal combustion engine of a vehicle and the like.

Accordingly, the fluid control valve mechanism 2 is arranged to be orthogonal relative to the camshaft 8 while the spool valve 25 is moved in the orthogonal direction relative to the camshaft 8, thereby supplying or discharging of the operational oil relative to the advanced angle chambers 6*a* or the retarded angle chambers 6*b* is controlled. Therefore, a length of the fluid control valve portion is sufficiently maintained, and a length of the valve timing control apparatus 1 is not elongated. Accordingly, controllability of the operational oil relative to the advanced angle chambers 6*a* and the retarded angle chambers 6*b* is improved while a size is reduced so as to improve mountability on the engine.

According to the embodiments, the fluid control valve portion 2 is arranged at a position orthogonal to an axis of the camshaft 8.

Accordingly, the fluid control valve mechanism 2 is arranged so as to be orthogonal to the camshaft 8 and so as to overlap with the camshaft 8. Therefore, in addition to the length of the valve timing control apparatus 1 in the longitudinal direction thereof, a length of the valve timing control apparatus 1 in the orthogonal direction relative to the camshaft 8 may be downsized.

According to the embodiments, a fluid supplying passage 33 is provided, the fluid supplying passage 33 supplying the fluid from a side of the camshaft 8 to the fluid control valve portion 2.

A known engine usually includes a cam journal fluid passage for supplying a lubrication fluid to a side of a camshaft, at an inside of the engine. According to the embodiment, the fluid supplying passage 33 for supplying the fluid from the side of the camshaft 8, is provided. Therefore, a fluid passage for the valve timing control apparatus 1 is not necessarily separately provided. Accordingly, cost for manufacturing the valve timing control apparatus 1 is decreased.

According to the embodiments, a recessed portion 14 is formed at the inner rotor 5 at a side of an axis of the camshaft 8, the recessed portion 14 opening toward an opposite side of the camshaft 8. A housing 23 is provided, the housing 23 including a protruding portion 23*b* inserted into the recessed portion 14. The fluid control valve mechanism 2 is provided at the housing 23.

Accordingly, the fluid control valve portion includes the protruding portion 23*b*, which is fitted into the recessed portion 14 of the inner rotor 5 so that the fluid control valve portion is connected to the inner rotor 5. Therefore, a member for connecting the fluid control valve mechanism 2 to either the inner rotor 5 or the outer rotor 3, is not necessarily separately provided. Therefore, the valve timing control apparatus 1 may be downsized.

According to the embodiments, the protruding portion 23*b* is formed with a supply side fluid passage 47 communicating with the fluid supplying passage 33 and extending to the fluid control valve portion 2, an advanced angle side fluid passage 42 supplying the fluid from the fluid control valve portion 2 to the advanced angle chambers 6*a*, and a retarded angle side fluid passage 43 supplying the fluid from the fluid control valve portion 2 to the retarded angle chambers 6*b*. The supply side fluid passage 47 includes a first spherical valve body 15*c* restricting a flow of the fluid from the supply side fluid passage 47 toward a side of the fluid supplying passage 33.

Accordingly, the supply side fluid passage 47, the advanced angle side fluid passage 42 and the retarded angle side fluid passage 43 are formed at the protruding portion 23*b*. Therefore, a fluid passage is not necessarily separately provided. Accordingly, the valve timing control apparatus 1 may be downsized.

According to the embodiments, a phase displacement lock mechanism 9*b* is provided, the phase displacement lock mechanism 9*b* locking a relative rotation between the inner rotor 5 and the outer rotor 3 so as to create a locked state and releasing the relative rotation between the inner rotor 5 and the outer rotor 3 so as to create a released state, in which the locked state is released. A phase displacement lock valve portion 100 is provided at the housing 23, the phase displacement lock valve portion 100 including an operational member 104 moving linearly in the orthogonal direction relative to the camshaft 8, thereby controlling supplying and discharging of the fluid relative to the phase displacement lock mechanism 9*b*. A lock fluid passage 99 is formed at the protruding portion 23*b*, the lock fluid passage 99 supplying the fluid from the phase displacement lock valve portion 100 to the phase displacement lock mechanism 9*b* and discharging the fluid from the phase displacement lock mechanism 9*b* to the phase displacement lock valve portion 100.

Accordingly, the lock fluid passage 99 for supplying and discharging the fluid relative to the phase displacement lock mechanism 9*b*, as well as the supply side fluid passage 47, the advanced angle side fluid passage 42 and the retarded angle side fluid passage 43 are formed at the protruding portion 23*b*. Therefore, each of the fluid passages is arranged close to each other. Accordingly, the valve timing control apparatus 1 may be downsized.

According to the embodiments, a phase displacement lock mechanism 9*b* is provided, the phase displacement lock mechanism 9*b* locking a relative rotation between the inner rotor 5 and the outer rotor 3 so as to create a locked state and releasing the relative rotation between the inner rotor 5 and the outer rotor 3 so as to create a released state, in which the locked state is released. The protruding portion 23*b* is formed with a supply side fluid passage 47 communicating with the fluid supplying passage 33 and extending to the fluid control valve mechanism 2, an advanced angle side fluid passage 42 supplying the fluid from the fluid control valve mechanism 2 to the advanced angle chambers 6*a*, and a retarded angle side fluid passage 43 supplying the fluid from the fluid control valve mechanism 2 to the retarded angle chambers 6*b*. A phase displacement lock valve portion 100 is provided at the housing 23, the phase displacement lock valve portion 100 including a second linearly moving member 104 linearly moving in the orthogonal direction relative to the camshaft 8, thereby controlling supplying and discharging of the fluid relative to the phase displacement lock mechanism 9*b*, a lock fluid passage 99 is formed at the protruding portion 23*b*, the lock fluid passage 99 supplying the fluid from the phase displacement lock valve portion 100 to the phase displacement lock mechanism 9*b* and discharging the fluid from the phase displacement lock mechanism 9*b* to the phase displacement lock valve portion 100. The lock fluid passage 99, which is formed at the protruding portion 23*b* so as to extend from the side of the axis of the camshaft 8 in a radially outer direction of the camshaft 8 when seen in a cross-sectional view taken in a radial direction of the camshaft 8, is arranged between the advanced angle side fluid passage 42 and the retarded angle side fluid passage 43, each of which is formed at the protruding portion 23*b* so as to extend from the side of the axis of the camshaft 8 in the radially outer direction of the camshaft 8 when seen in the cross-sectional view taken in the radial direction of the camshaft 8.

Accordingly, the advanced angle side fluid passage 42 and the retarded angle side fluid passage 43 are arranged next to each other. Therefore, when the relative rotational phase is switched in the advanced angle direction S1 or the retarded angle direction S2, a fluid pressure of one of the advanced angle side fluid passage 42 and the retarded angle side fluid passage 43 for supplying the fluid to the advanced angle chambers 6*a* or the retarded angle chambers 6*b*, becomes higher than a fluid pressure of the other one of the advanced angle side fluid passage 42 and the retarded angle side fluid passage 43. Consequently, when the retarded angle chambers 6*b*, the advanced angle side fluid passage 42 and the retarded angle side fluid passage 43 are arranged close to each other, due to a difference between the fluid pressure of the advanced angle side fluid passage 42 and that of the retarded angle side fluid passage 43, the seals 27, which are arranged between the advanced angle side fluid passage 42 and the retarded angle side fluid passage 43, may be moved in the axial direction of the camshaft 8. Therefore, when the relative rotational phase is often switched, expensive seals, which are resistant to abrasion, may be necessary. On the other hand, a fluid pressure is applied in the lock fluid passage 99 when the rotational phase is switched in the advanced angle direction S1 or the retarded angle direction S2. The fluid pressure of the lock fluid passage 99 is substantially equal to or higher than the fluid pressure of the advanced angle side fluid passage 42 and the fluid pressure of the retarded angle side fluid passage 43. Therefore, the seal 27, which is arranged between the advanced angle side fluid passage 42 and the lock fluid passage 99, is held in a state where the fluid pressure is applied to a side of the advanced angle side fluid passage 42 while the seal 27; which is arranged between the retarded angle side fluid passage 43 and the lock fluid passage 99, is held in a state where the fluid pressure is applied to a side of the retarded angle side fluid passage 43. Consequently, the seals 27 are less likely to move in the axial direction of the camshaft 8, and the seals 27 are less likely to wear out. Accordingly, an inexpensive seal may be used.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus comprising:

a driving side rotational member rotating synchronously with a crankshaft of an internal combustion engine;

a driven side rotational member arranged coaxially with the driving side rotational member and rotating synchronously with a camshaft for opening and closing a valve of the internal combustion engine;

a fluid pressure chamber formed at one of the driving side rotational member and the driven side rotational member;

a dividing portion formed at the other one of the driving side rotational member and the driven side rotational member so as to divide the fluid pressure chamber into an advanced angle chamber and a retarded angle chamber; and a fluid control valve portion arranged orthogonally relative to the camshaft at an opposite side of the camshaft so as to dispose the driving side rotational member and the driven side rotational member between the fluid control valve portion and the camshaft, the fluid control valve portion including a first linearly moving member linearly moving in an orthogonal direction relative to the camshaft, thereby controlling supplying and discharging of a fluid relative to the advanced angle chamber and the retarded angle chamber, wherein the fluid control valve portion is positioned orthogonally to an axis of the camshaft.

2. The valve timing control apparatus according to claim 1, wherein a fluid supplying passage is provided, the fluid supplying passage supplying the fluid from a side of the camshaft to the fluid control valve portion.

3. The valve timing control apparatus according to claim 2, wherein a recessed portion is formed at the driven side rotational member at a side of an axis of the camshaft, an opening side of the recessed portion being an opposite side of the camshaft, a housing is provided, the housing including a protruding portion inserted into the recessed portion, and wherein the fluid control valve portion is provided at the housing.

4. The valve timing control apparatus according to claim 3, wherein a phase displacement lock mechanism is provided, the phase displacement lock mechanism locking a relative rotation between the driven side rotational member and the driving side rotational member so as to create a locked state and releasing the relative rotation between the driven side rotational member and the driving side rotational member so as to create a released state, in which the locked state is released, the protruding portion is formed with a supply side fluid passage communicating with the fluid supplying passage and extending to the fluid control valve portion, an advanced angle side fluid passage supplying the fluid from the fluid control valve portion to the advanced angle chamber, and a retarded angle side fluid passage supplying the fluid from the fluid control valve portion to the retarded angle chamber, a phase displacement lock valve portion is provided at the housing, the phase displacement lock valve portion including a second linearly moving member linearly moving in the orthogonal direction relative to the camshaft, thereby controlling supplying and discharging of the fluid relative to the phase displacement lock mechanism, a lock fluid passage is formed at the protruding portion, the lock fluid passage supplying the fluid from the phase displacement lock valve portion to the phase displacement lock mechanism and discharging the fluid from the phase displacement lock mechanism to the phase displacement lock valve portion, and wherein the lock fluid passage, which is formed at the protruding portion so as to extend from the side of the axis of the camshaft in a radially outer direction of the camshaft when seen in a cross-sectional view taken in a radial direction of the camshaft, is arranged between the advanced angle side fluid passage and the retarded angle side fluid passage, each of which is formed at the protruding portion so as to extend from the side of the axis of the camshaft in the radially outer direction of the camshaft when seen in the cross-sectional view taken in the radial direction of the camshaft.

5. The valve timing control apparatus according to claim 3, wherein the protruding portion is formed with a supply side fluid passage communicating with the fluid supplying passage and extending to the fluid control valve portion, an advanced angle side fluid passage supplying the fluid from the fluid control valve portion to the advanced angle chamber, and a retarded angle side fluid passage supplying the fluid from the fluid control valve portion to the retarded angle chamber, and wherein the supply side fluid passage includes a check valve restricting a flow of the fluid from the supply side fluid passage toward a side of the fluid supplying passage.

6. The valve timing control apparatus according to claim 5, wherein a phase displacement lock mechanism is provided, the phase displacement lock mechanism locking a relative rotation between the driven side rotational member and the driving side rotational member so as to create a locked state and releasing the relative rotation between the driven side rotational member and the driving side rotational member so as to create a released state, in which the locked state is released, a phase displacement lock valve portion is provided at the housing, the phase displacement lock valve portion including a second linearly moving member moving linearly in the orthogonal direction relative to the camshaft, thereby controlling supplying and discharging of the fluid relative to the phase displacement lock mechanism, and wherein a lock fluid passage is formed at the protruding portion, the lock fluid passage supplying the fluid from the phase displacement lock valve portion to the phase displacement lock mechanism and discharging the fluid from the phase displacement lock mechanism to the phase displacement lock valve portion.

7. The valve timing control apparatus according to claim 3, wherein a phase displacement lock mechanism is provided, the phase displacement lock mechanism locking a relative rotation between the driven side rotational member and the driving side rotational member so as to create a locked state and releasing the relative rotation between the driven side rotational member and the driving side rotational member so as to create a released state, in which the locked state is released, a phase displacement lock valve portion is provided at the housing, the phase displacement lock valve portion including a second linearly moving member moving linearly in the orthogonal direction relative to the camshaft, thereby controlling supplying and discharging of the fluid relative to the phase displacement lock mechanism, and wherein a lock fluid passage is formed at the protruding portion, the lock fluid passage supplying the fluid from the phase displacement lock valve portion to the phase displacement lock mechanism and discharging the fluid from the phase displacement lock mechanism to the phase displacement lock valve portion.

8. The valve timing control apparatus according to claim 1, wherein a recessed portion is formed at the driven side rotational member at a side of an axis of the camshaft, an opening side of the recessed portion being an opposite side of the camshaft, a housing is provided, the housing including a protruding portion inserted into the recessed portion, and wherein the fluid control valve portion is provided at the housing.

9. The valve timing control apparatus according to claim 8, wherein the protruding portion is formed with a supply side fluid passage communicating with a fluid supplying passage and extending to the fluid control valve portion, an advanced angle side fluid passage supplying the fluid from the fluid control valve portion to the advanced angle chamber, and a retarded angle side fluid passage supplying the fluid from the fluid control valve portion to the retarded angle chamber, and wherein the supply side fluid passage includes a check valve restricting a flow of the fluid from the supply side fluid passage toward a side of the fluid supplying passage.

10. The valve timing control apparatus according to claim 9, wherein a phase displacement lock mechanism is provided, the phase displacement lock mechanism locking a relative rotation between the driven side rotational member and the driving side rotational member so as to create a locked state and releasing the relative rotation between the driven side rotational member and the driving side rotational member so as to create a released state, in which the locked state is released, a phase displacement lock valve portion is provided at the housing, the phase displacement lock valve portion including a second linearly moving member moving linearly in the orthogonal direction relative to the camshaft, thereby controlling supplying and discharging of the fluid relative to the phase displacement lock mechanism, and wherein a lock fluid passage is formed at the protruding portion, the lock fluid passage supplying the fluid from the phase displacement lock valve portion to the phase displacement lock mechanism and discharging the fluid from the phase displacement lock mechanism to the phase displacement lock valve portion.

11. The valve timing control apparatus according to claim 8, wherein a phase displacement lock mechanism is provided, the phase displacement lock mechanism locking a relative rotation between the driven side rotational member and the driving side rotational member so as to create a locked state and releasing the relative rotation between the driven side rotational member and the driving side rotational member so as to create a released state, in which the locked state is released, a phase displacement lock valve portion is provided at the housing, the phase displacement lock valve portion including a second linearly moving member moving linearly in the orthogonal direction relative to the camshaft, thereby controlling supplying and discharging of the fluid relative to the phase displacement lock mechanism, and wherein a lock fluid passage is formed at the protruding portion, the lock fluid passage supplying the fluid from the phase displacement lock valve portion to the phase displacement lock mechanism and discharging the fluid from the phase displacement lock mechanism to the phase displacement lock valve portion.

12. The valve timing control apparatus according to claim 8, wherein a phase displacement lock mechanism is provided, the phase displacement lock mechanism locking a relative rotation between the driven side rotational member and the driving side rotational member so as to create a locked state and releasing the relative rotation between the driven side rotational member and the driving side rotational member so as to create a released state, in which the locked state is released, the protruding portion is formed with a supply side fluid passage communicating with a fluid supplying passage and extending to the fluid control valve portion, an advanced angle side fluid passage supplying the fluid from the fluid control valve portion to the advanced angle chamber, and a retarded angle side fluid passage supplying the fluid from the fluid control valve portion to the retarded angle chamber, a phase displacement lock valve portion is provided at the housing, the phase displacement lock valve portion including a second linearly moving member linearly moving in the orthogonal direction relative to the camshaft, thereby controlling supplying and discharging of the fluid relative to the phase displacement lock mechanism, a lock fluid passage is formed at the protruding portion, the lock fluid passage supplying the fluid from the phase displacement lock valve portion to the phase displacement lock mechanism and discharging the fluid from the phase displacement lock mechanism to the phase displacement lock valve portion, and wherein the lock fluid passage, which is formed at the protruding portion so as to extend from the side of the axis of the camshaft in a radially outer direction of the camshaft when seen in a cross-sectional view taken in a radial direction of the camshaft, is arranged between the advanced angle side fluid passage and the retarded angle side fluid passage, each of which is formed at the protruding portion so as to extend from the side of the axis of the camshaft in the radially outer direction of the camshaft when seen in the cross-sectional view taken in the radial direction of the camshaft.

13. A valve timing control apparatus comprising:

a driving side rotational member rotating synchronously with a crankshaft of an internal combustion engine;

a driven side rotational member arranged coaxially with the driving side rotational member and rotating synchronously with a camshaft for opening and closing a valve of the internal combustion engine;

a fluid pressure chamber formed at one of the driving side rotational member and the driven side rotational member;

a dividing portion formed at the other one of the driving side rotational member and the driven side rotational member so as to divide the fluid pressure chamber into an advanced angle chamber and a retarded angle chamber; and a fluid control valve portion extending in a radial direction of the driving side rotational member and the driven side rotational member, arranged at an opposite side of the camshaft so as to dispose the driving side rotational member and the driven side rotational member between the fluid control valve portion and the camshaft, and including a linearly moving member at an inside of the fluid control valve portion, the linearly moving member controlling supplying and discharging of a fluid relative to the advanced angle chamber and the retarded angle chamber.

14. The valve timing control apparatus according to claim 13, wherein a fluid supplying passage is provided, the fluid supplying passage supplying the fluid from a side of the camshaft to the fluid control valve portion.

* * * * *